US010167751B2

(12) United States Patent
Ebert et al.

(10) Patent No.: US 10,167,751 B2
(45) Date of Patent: Jan. 1, 2019

(54) INTERNAL COMBUSTION ENGINE HAVING AN ENGINE BACKPRESSURE BRAKE AND A COMPRESSION RELEASE ENGINE BRAKE

(71) Applicant: MAN Truck & Bus AG, München (DE)

(72) Inventors: Christoph Ebert, Nürnberg (DE); Tobias Herrmann, Nürnberg (DE); Adrian Fink, Nürnberg (DE)

(73) Assignee: MAN TRUCK & BUS AG, München (DE)

( * ) Notice: Subject to any disclaimer, the term of this patent is extended or adjusted under 35 U.S.C. 154(b) by 102 days.

(21) Appl. No.: 15/388,054

(22) Filed: Dec. 22, 2016

(65) Prior Publication Data

US 2017/0175598 A1 Jun. 22, 2017

(30) Foreign Application Priority Data

Dec. 22, 2015 (DE) ..... 10 2015 016 723

(51) Int. Cl.
*F01L 13/06* (2006.01)
*F02D 13/04* (2006.01)
(Continued)

(52) U.S. Cl.
CPC ..... *F01L 13/06* (2013.01); *F01L 1/181* (2013.01); *F01L 1/2411* (2013.01); *F02D 9/06* (2013.01);
(Continued)

(58) Field of Classification Search
CPC ..... F01L 13/06; F02D 9/06; F02D 13/04
(Continued)

(56) References Cited

U.S. PATENT DOCUMENTS 5,692,469 A 12/1997 Rammer et al.
6,705,282 B2 * 3/2004 Hlavac ..... F02D 13/04 123/322
(Continued)

FOREIGN PATENT DOCUMENTS

DE 3923371 C1 6/1990
DE 102012100962 A1 8/2012
(Continued)

OTHER PUBLICATIONS

European Search Report issued in corresponding EP application No. 16002472.5 dated Jun. 1, 2017.

*Primary Examiner* — Hieu T Vo
*Assistant Examiner* — Arnold Castro
(74) *Attorney, Agent, or Firm* — Weber Rosselli & Cannon LLP

(57) ABSTRACT

An internal combustion engine having at least one outlet valve per cylinder, which can be actuated via a camshaft and a transmission device, a hydraulic valve clearance compensation element being arranged in the transmission device between the camshaft and the outlet valve, and having an engine braking device, having an engine backpressure brake for building up an exhaust gas backpressure and a compression release engine brake, by way of which at least one outlet valve can be held open at least in an engine braking phase, the compression release engine brake being formed by the hydraulic valve clearance compensation element.

7 Claims, 4 Drawing Sheets

(51) Int. Cl.

| | |
|---|---|
| ***F02D 13/06*** | (2006.01) |
| ***F02D 17/02*** | (2006.01) |
| ***F01L 1/18*** | (2006.01) |
| ***F01L 1/24*** | (2006.01) |
| ***F02D 9/06*** | (2006.01) |

(52) U.S. Cl.
CPC ..... *F02D 13/04* (2013.01); *F02D 13/06* (2013.01); *F02D 17/02* (2013.01)

(58) Field of Classification Search
USPC ..... 123/320, 323
See application file for complete search history.

(56) References Cited

U.S. PATENT DOCUMENTS

| | | | | |
|---|---|---|---|---|
| 6,925,976 | B2 * | 8/2005 | Israel | F01L 1/08 123/321 |
| 7,055,496 | B1 * | 6/2006 | Majewski | F02D 9/06 123/319 |
| 8,499,740 | B2 * | 8/2013 | Yoon | F01L 1/181 123/321 |
| 2008/0223325 | A1 * | 9/2008 | Meistrick | F01L 13/065 123/90.46 |
| 2010/0006063 | A1 * | 1/2010 | Dilly | F01L 1/26 123/347 |
| 2011/0277729 | A1 * | 11/2011 | Afjeh | F02D 13/04 123/321 |
| 2013/0068195 | A1 | 3/2013 | Ruggiero et al. | |

FOREIGN PATENT DOCUMENTS

| | | | |
|---|---|---|---|
| EP | 0736672 | A2 | 10/1996 |
| EP | 2143894 | A1 | 1/2010 |
| EP | 2143896 | A1 | 1/2010 |
| WO | 2004/081352 | A1 | 9/2004 |

* cited by examiner

INTERNAL COMBUSTION ENGINE HAVING AN ENGINE BACKPRESSURE BRAKE AND A COMPRESSION RELEASE ENGINE BRAKE

BACKGROUND

1. Technical Field

The present disclosure relates to an internal combustion engine having at least one outlet valve per cylinder, which outlet valve can be actuated via a camshaft and a transmission device, a hydraulic valve clearance compensation element being arranged in the transmission device between the camshaft and the outlet valve, and having an engine braking device, having an engine backpressure brake for building up an exhaust gas back pressure and a compression release engine brake, by way of which at least one outlet valve can be held open at least in an engine braking phase.

2. Discussion of Related Art

Laid open specifications EP 2 143 894 A1 and EP 2 143 896 A1 have disclosed internal combustion engines having engine braking devices and valve clearance compensation mechanisms. Here, in each case one hydraulic valve clearance compensation mechanism is arranged in a valve crosshead. Here, the valve clearance compensation mechanism has a piston which adjoins a pressure space, the pressure space being flow-connected via a check valve to a pressure line which has a constant pressure. A relief line emanates from the pressure space, which relief line opens via a controllable relief valve into an oil outlet opening. Furthermore, a hydraulic additional valve control unit of the engine control device is arranged in the valve crosshead, the control pressure space of which additional valve control unit is flow-connected to the pressure space of the controllable relief valve. The control pressure space is flow-connected via an oil duct to a control pressure line on a counterholder, a counterholder making contact via a stop piston with the valve crosshead on a side which faces away from the outlet valves. As a result of the numerous hydraulic pistons and pressure lines which are arranged in the valve crosshead, high machining and manufacturing complexity of the valve crosshead is required, the valve crosshead being weakened structurally and therefore having to be of correspondingly solid design.

The engine braking devices which are described in the cited documents are in each case a mixed form of an engine backpressure brake and a compression release engine brake, which mixed form is also called, in particular, an EVB ("exhaust valve brake"). Here, the hydraulic additional valve control unit is installed on one side into a valve crosshead of the con-necting mechanism, which valve crosshead at the same time actuates two outlet valves. The hydraulic additional valve control unit is fed oil by means of the oil circuit of the respective internal combustion engine which is present in any case. In this type of engine braking devices, the use of hydraulic valve clearance compensation devices requires additional measures, in order to avoid uncontrolled pumping up of the valve clearance compensation device during the engine braking mode, which might lead to serious engine damage. In EP 2 143 894 A1 and EP 2 143 896 A1, this takes place by virtue of the fact that the pressure space of the hydraulic valve clearance compensation device is relieved of pressure during the engine braking mode via a controllable relief valve. The arrangement which is known from the prior art with numerous oil bores and hydraulic pistons in the valve crosshead has the disadvantage that the valve crosshead is weakened structurally and therefore has to be of greater dimensions.

Laid open specification DE 10 2012 100 962 A1 describes a possibility of combining a hydraulic valve clearance compensation means with a relief valve and therefore at the same time implementing an engine braking device and a maintenance-free valve train only by way of a hydraulic valve clearance compensation means. The compression release engine brake is therefore formed by way of the hydraulic valve clearance compensation element. In order to avoid the outlet valve being held open in an undesired manner by way of the hydraulic valve clearance compensation means after the engine braking mode has ended, the following components are also required for a braking mode in addition to the customary components of a hydraulic valve clearance compensation means, however: a relief line with a controllable relief valve including a control line, and a hold-down with a setting screw.

The function of this embodiment is similar to the EVB engine braking device which is described in laid open specifications EP 2 143 894 A1 and EP 2 143 896 A1 and can be described as follows: if the exhaust gas throttle valve is closed, the exhaust gas pressure rises in the outlet duct before the compression (bottom dead centre) to such a pronounced extent that the outlet valve is briefly pressed open by way of the pressure wave of an adjacent cylinder. The piston of the hydraulic valve clearance compensation means which is permanently loaded with engine oil pressure prevents renewed closure of the valve. A small stroke remains, as a result of which a part of the compressed air can already flow out of the cylinder during the compression stroke in the engine. After the top dead centre is reached, the said opening is maintained. The pressure on the piston which then moves downwards is reduced substantially, and the braking performance is improved. As a result of the throttling of the exhaust gas, both the upward and the downward movement of the engine piston can be utilized for braking. At the same time, the relief valve is switched in the engine braking mode, which relief valve opens a relief bore to the high pressure space of the hydraulic valve clearance compensation means. The said relief bore is first of all still closed by way of the hold-down, however. At the beginning of the injection stroke, the relief bore is opened by way of the rocker arm movement, the oil escapes and relieves the piston. The "extended" piston of the hydraulic valve clearance compensation means can therefore be reset again and can completely close the outlet valve again.

The abovementioned components are therefore still also necessary for a braking mode in this solution, in the form of the relief line with a controllable relief valve including a control line, and a hold-down with a setting screw, in addition to a classic hydraulic valve clearance compensation means.

SUMMARY

It is therefore an object of the present disclosure to provide both an engine brake and an automatic valve clearance compensation means in an improved manner. The present disclosure is based, in particular, on the object of providing an engine brake and an automatic valve clearance compensation means in a manner which is simpler, less expensive and uses less installation space.

The said objects are achieved by way of an apparatus having the features of the independent claim. Advantageous embodiments and applications of the present disclosure are the subject matter of the dependent claims and will be explained in greater detail in the following description with partial reference to the figures.

According to general aspects of the present disclosure, an apparatus, in particular an internal combustion engine, is provided having at least one outlet valve per cylinder, which outlet valve can be actuated via a camshaft and a mechanical transmission device. Here, a hydraulic valve clearance compensation element is arranged in the transmission device between the camshaft and the outlet valve. The hydraulic valve clearance compensation element can include a piston which adjoins a pressure space and an oil pressure line which opens into the pressure space via a check valve which is loaded by way of a spring.

Hydraulic valve clearance compensation elements in the internal combustion engines are known per se and serve, in particular, to compensate for the length dimensions of the gas exchange valves, which length dimensions change over the service life, in such a way that reliable valve closure is ensured in the base circle phase of the cam which actuates the valve. Here, secondly, the cam lift is to be transmitted without loss to the valve and therefore to be converted into a valve stroke movement. The method of operation of hydraulic valve clearance compensation elements of this type which are arranged in the force flow of a valve controller, in particular of an internal combustion engine, will be presumed to be known in the following text.

Furthermore, the internal combustion engine includes an engine speed limiting device which is configured to deactivate an injection of fuel above a predetermined cut-off engine speed.

Furthermore, the internal combustion engine includes an engine braking device, having an engine backpressure brake which is known per se for building up an exhaust gas back pressure. The engine backpressure brake can include, for example, a pressure flap which is arranged in the exhaust gas section and can be controlled or regulated. When the flap is closed, the backpressure is increased on the side which lies counter to the flow direction, and thus provides a braking action which acts on the drive engine of the motor vehicle.

Furthermore, the engine braking device includes a compression release engine brake, by way of which at least one outlet valve can be held open at least in an engine braking phase. The compression release engine brake is initiated in a gas-controlled manner via the increased exhaust gas backpressure if a braking flap is at least partially closed, in which "valve jump" of the outlet valves is triggered in a targeted manner.

In accordance with the present disclosure the compression release engine brake is formed here by the hydraulic valve clearance compensation element. In other words, the engine backpressure brake and the hydraulic valve clearance compensation element are designed in such a way that a sum of the forces which act on the outlet valve lead in the engine braking mode to an open position of the outlet valve. The forces which act on the outlet valve comprise firstly a valve spring force of the outlet valve, a gas pressure force which is produced on the combustion chamber side, which forces act in each case in the closing direction of the outlet valve, a frictional force which acts in the transmission device, and secondly a gas pressure force of the exhaust gas pressure which is produced by the engine backpressure brake, an oil pressure force which is produced by the valve clearance compensation element, and a spring force of the restoring spring of the hydraulic valve clearance compensation element, which forces act in each case in a direction which is opposed to the closing direction. In the engine braking mode, a force which is exerted by the hydraulic valve clearance compensation element therefore acts on the outlet valve together with the gas force of the exhaust gas pressure which is produced by the engine backpressure brake, and leads to the outlet valve being pressed into the open position and/or being held in the open position.

The hydraulic valve clearance compensation means therefore assumes a double function. Firstly, a maintenance-free valve train is realised by way of it in a conventional way, and secondly it is used in the engine braking mode for increasing the braking performance, in which at least one outlet valve can be held open by means of the hydraulic valve train in an engine braking phase, with the result that the hydraulic valve train also assumes the function of a compression release engine brake. This saves components and costs.

One particular advantage of the present disclosure lies in the fact that the hydraulic valve clearance compensation means can be configured as a classic or conventional hydraulic valve clearance compensation means, that is to say can be provided in the form of a hydraulic valve clearance compensation means which does not have any additional means for making an accelerated pressure relief of the pressure space of the hydraulic valve clearance compensation means possible, in order to make more rapid closure of the outlet valve possible after ending of the engine braking mode.

In order to ensure that the outlet valves are closed again completely after ending of the engine braking mode before the combustion mode, and in order thus to ensure a reliable transition from an engine braking mode into the combustion mode, the transmission device, the engine backpressure brake and the hydraulic valve clearance compensation element are designed in such a way that an engine speed limit, above which a gap occurs between the outlet valve and the associated valve seat ring in the cam base circle phase in the engine braking mode, lies above the cut-off engine speed by a distance value.

In particular, the transmission device, the engine backpressure brake and the hydraulic valve clearance compensation element can be designed in such a way that a sum of the forces which act in the closing direction on the outlet valve in a cam base circle phase is greater only in the case of an engine speed of the internal combustion engine below the predetermined engine speed limit than a sum of the forces which act in an opening direction, with the result that the outlet valve is held in the closed position in the cam base circle phase at an engine speed of the internal combustion engine below the engine speed limit and is moved into the open position at an engine speed of the internal combustion engine which is greater than or equal to the engine speed limit. The opening direction is that direction, in which the outlet valve moves from the closed position into an open position, or that direction, in which the outlet valve moves away from its associated valve seat ring, or that direction, in which the outlet valve moves towards the piston of the cylinder or the cylinder base. The closing direction is opposed hereto.

In other words, the forces which are produced by the components of the internal combustion engine and act on the outlet valve are fixed in such a way that valve jump or valve flutter can occur only above the cut-off engine speed in order to increase the engine braking action.

This ensures that the engine speed ranges, in which in each case a combustion mode and valve jump can occur, are separated from one another. Therefore, after the end of an engine braking phase, a combustion mode can commence again only if the outlet valve which is held open by the valve clearance compensation element in the context of a compression release braking function is moved out of the open position into the closed position again.

Here, a "cam base circle phase" is intended to be understood to mean, in particular, an angular region of the cam unit, in which cam contours of all part cams of the cam unit assume a common base circle level. Furthermore, a "cam base circle phase" is intended to be understood to mean, in particular, an angular region of the cam unit, in which a gas exchange valve which is assigned to the cam unit is closed, if there is no compression release engine brake. The compression release engine brake serves to produce opening of the gas exchange valves, in particular of the outlet valves, in the cam base circle phase in a targeted manner, in order to make it possible to utilize the compression work which is done for braking purposes. Here, the pressure in the cylinder is dissipated by way of targeted opening of a gas exchange valve in such a way that only a reduced amount of work can be output to the crankshaft in the subsequent expansion stroke.

The forces of the internal combustion engine which act on the outlet valve in the closing direction preferably comprise a valve spring force of the outlet valve and a gas pressure force which is produced on the combustion chamber side. The forces which act in an opening direction preferably comprise a gas pressure force of the exhaust gas pressure which is produced by the engine backpressure brake, an oil pressure force which is produced by the valve clearance compensation element, and a spring force of the restoring spring of the hydraulic valve clearance compensation element.

A design according to the present disclosure of the internal combustion engine for adapting the engine speed limit, above which a gap occurs between the outlet valve 1 and the valve seat ring, is understood to mean an expedient adaptation of this type of the said influencing variables and/or forces. Depending on the design, the engine speed limit, above which valve jump occurs, can be shifted towards greater or smaller values.

For example, a shift of the engine speed limit towards greater values can be achieved by way of at least one of the following measures: reducing the exhaust gas pressure, for example by way of a reduction of the closed position of the pressure flap; increasing the gas pressure on the combustion chamber side; reducing the oil pressure which prevails at the hydraulic valve clearance compensation means; reducing the spring force of the restoring spring of the hydraulic valve clearance compensation means; increasing the valve spring force; or increasing the friction in the valve train. A shift of the occurrence of the gap towards higher engine speeds can be achieved by way of at least one of the said measures.

In this way, the engine speed limit, above which valve jump of the outlet valve takes place in the cam base circle phase in the engine braking mode, can be set to a value which lies above the cut-off engine speed by a desired distance value.

According to one embodiment, a relief line which emanates from a pressure space of the valve clearance compensation element and can be connected to a pressure sink via a controllable relief valve is not provided. Furthermore, one particularly advantageous variant of the said embodiment provides that a counterholder which is configured to open an outlet opening of the relief line only at the beginning of an outlet stroke is not provided. In particular, a counterholder, against which the transmission device bears in an end position, is not provided. As a result, costs for the said additional parts and the installation space which is required for this purpose can be saved.

In another embodiment, the mechanical transmission device comprises a valve crosshead and a valve lever which is configured as a rocker arm or drag lever, is driven by the camshaft and acts on the outlet valves via the valve crosshead.

According to a further embodiment, a piston, a check valve and a spring of the hydraulic valve clearance compensation element can be arranged between the valve lever and the valve crosshead. Depending on the valve train construction, however, other installation loca-tions or designs for the hydraulic valve clearance compensation means are also possible. For example, the hydraulic valve clearance compensation means can be arranged between the push rod and the rocker arm, integrated into a bucket tappet or a valve tappet.

The hydraulic valve clearance compensation element is preferably configured in such a way that a duration of the closing time corresponds substantially to a duration which leakage-induced restoring operation of the deflected piston of the hydraulic valve clearance compensation element lasts, which is triggered at the end of the engine braking mode by way of a reduction in a gas force of the exhaust gas pressure which acts on the outlet valve. This is the case, for example, when the hydraulic valve clearance compensation element does not have any additional means for making an accelerated pressure relief of the pressure space of the hydraulic valve clearance compensation means possible. In the case of a valve clearance compensation element of this type, after the gas force of the exhaust gas pressure has ended, the valve spring and the gas pressure from the combustion space ensure that the hydraulic valve clearance compensation element is pressed back into the starting position again. During "pressing back", oil is pressed out of the high pressure chamber via the leak-age gap, which corresponds to a reduction of the oil volume in the high pressure space of the hydraulic valve play compensation means.

The closing time of the outlet valve is understood to mean the time period between the opening of the engine backpressure brake, which corresponds to the end of the engine braking mode, and the closed position of the outlet valve which is held open by the hydraulic valve clearance compensation element in the engine braking mode. The closing time can be measured, for example, experimentally on a test bench.

According to at least one embodiment, the decrease of the gas force which is produced by the engine backpressure brake and not a change in the oil force which is produced by the valve clearance compensation element is substantially critical for the return of the outlet valve into the closed position after ending of the engine braking mode, and therefore also for the value of the closing time. A duration of the closing time can thus depend substantially on a reduction of a gas force of the exhaust gas pressure which acts on the outlet valve, which reduction is caused during opening of the engine backpressure brake at the end of the engine braking mode.

According to a further aspect, furthermore, the present disclosure relates to a motor vehicle, in particular a commercial vehicle, having an internal combustion engine, as described in this document.

BRIEF DESCRIPTION OF THE FIGURES

The above-described preferred embodiments and features of the present disclosure can be combined with one another as desired. Further details and advantages of the present disclosure will be described in the following text with reference to the appended drawings, in which.

Identical or functionally equivalent elements are denoted by the same reference numerals in all figures.

DETAILED DESCRIPTION

It is known in general to protect an internal combustion engine against impermissibly high engine speeds by way of the installation of an engine speed limiting device. Engine speed limiting is achieved by switching off the injection of fuel above a predetermined maximum engine speed. To this end, there is a corresponding control function in the respective injection controller. In the present case, the internal combustion engine therefore comprises the engine speed limiting device 10 which is configured to deactivate an injection of fuel above a predetermined cut-off engine speed n1.

Figure 1:
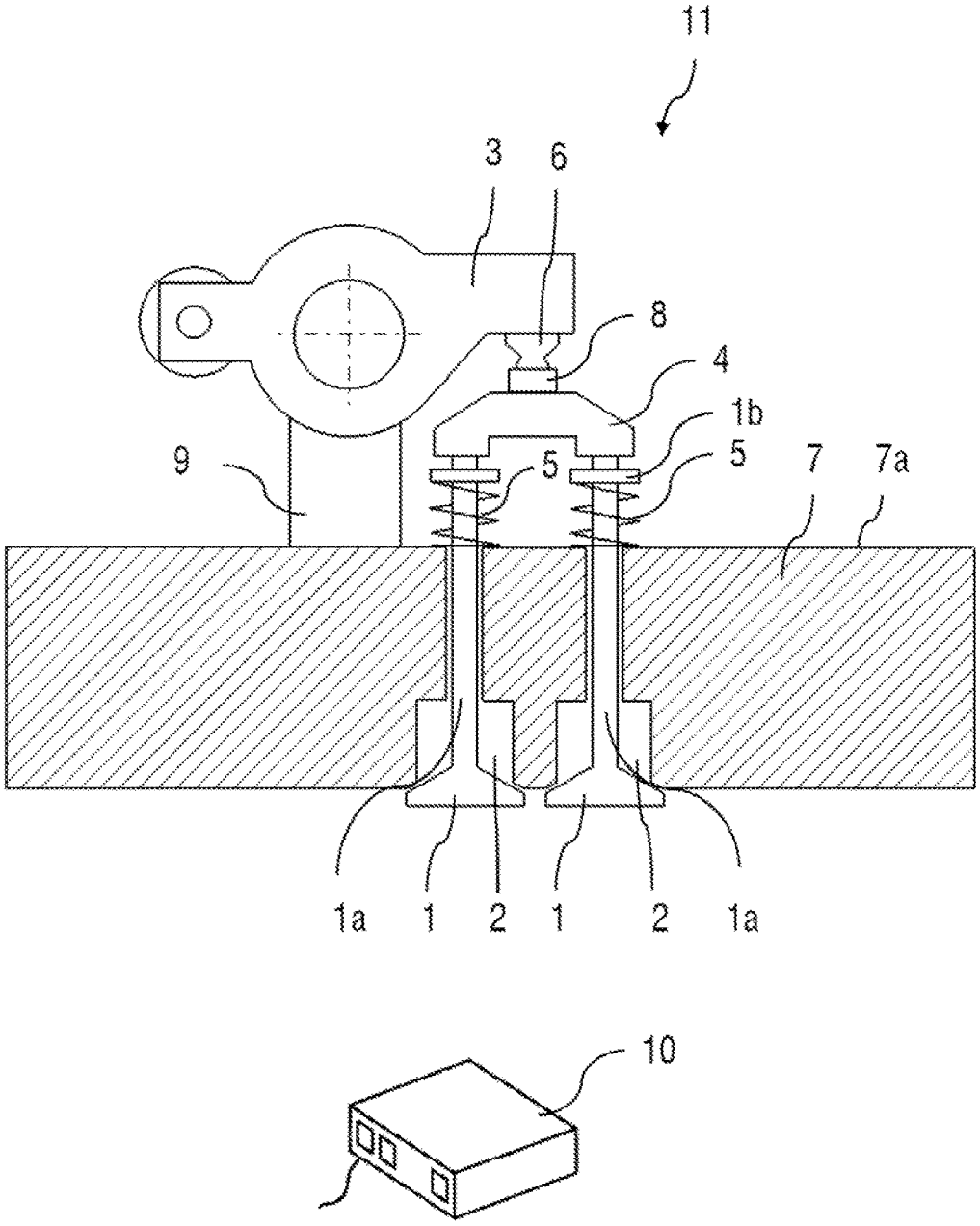
FIG. 1 shows a valve train with a hydraulic valve clearance compensation means according to one embodiment of the present disclosure.

Furthermore, FIG. 1 shows a valve train 11 with a hydraulic valve clearance compensation means 6 of an internal combustion engine according to one embodiment of the present disclosure. The internal combustion engine comprises a 4-stroke reciprocating piston internal combustion engine (not shown) which has at least one inlet valve (not shown) and two outlet valves 1 per cylinder.

The inlet and outlet valves 1 can be controlled by a camshaft (not shown). The camshaft can lie at the bottom or at the top in relation to the rocker arm 3. FIG. 1 corresponds to the ver-sion with an overhead camshaft (not shown) in the region of the controller of the two outlet valves 1 of a cylinder. The rocker arm 3 is mounted rotatably on the cylinder head 7 on a bearing block 9 on a bearing axle with a plain bearing.

The rocker arm 3 in turn acts on a valve crosshead 4. The said valve crosshead 4 serves to control the two outlet valves 1 of a cylinder (not shown) of the internal combustion engine (not shown), which outlet valves 1 are arranged axially parallel to one another. Each of the outlet valves 1 is mounted axially movably by way of its stem 1*a* in the cylinder head 7 (shown in a greatly diagrammatic manner) and is loaded in the closing direction C with a defined prestressing force F3 (see also FIG. 2) by way of a closing spring (restoring spring) 5 which is supported at one end on a cylinder head surface 7*a* and at the other end on a spring collar 1*b* which is fastened to the outlet valve stem 1*a*. Here, each of the two closing springs 5 can be realised either by way of only one helical spring or two helical springs which are coaxial with respect to one another.

A hydraulic valve clearance compensation element 6 is arranged between the rocker arm 3 and the valve crosshead 4, with the result that the rocker arm acts on the valve crosshead 4 and therefore on the outlet valves 1 via the hydraulic valve clearance compensation element 6 and a supporting cap 8 which is articulated in the manner of a ball joint.

The hydraulic valve clearance compensation element 6 which is configured in a manner known per se has a piston which adjoins a pressure space and an oil pressure line which opens into the pressure space via a check valve which is loaded by way of a spring (not shown in each case). The piston, the check valve and the spring of the hydraulic valve clearance compensation element 6 are arranged between the valve lever 3 and the valve crosshead 4.

The hydraulic valve clearance compensation element 6 serves, in particular, to compensate for the wear (the valve works its way into the valve seat) over the engine service life, with the result that reliable valve closure is ensured in the base circle phase of the cam which actuates the outlet valve 1.

The outlet ducts 2 of the cylinders open into an exhaust gas section of the internal combustion engine, into which an engine backpressure brake for building up an exhaust gas backpressure is installed in a manner known per se as close to the engine as possible. The said engine backpressure brake can be formed by a throttle valve or a disc valve or a slide. A throttle valve is used in most cases. Including its control and/or regulating members, the engine backpressure brake forms part of the engine braking device and serves during engine braking operations for shutting off the exhaust gas section at least partially and for backing up the exhaust gas in a manner which is brought about upstream as a result. A compression release engine brake for increasing the engine braking performance which is formed in the present case by the hydraulic valve clearance compensation element 6 is a further part of the engine braking device.

The function of the hydraulic valve clearance compensation element 6 for increasing the engine braking performance can be described as follows:

If the exhaust gas throttle valve is closed for an engine braking mode, a gas force F5 of the exhaust gas pressure which acts on the outlet valve 1 is built up. Here, the exhaust gas pressure in the outlet duct rises before the compression, in particular during the intake cycle before the bottom dead centre and at the bottom dead centre, to such an extent that the outlet valve 1 is pressed open briefly by way of the pressure wave of an adjacent cylinder, as a result of which a gap is formed between the outlet valve 1 and the valve seat ring and/or an opening to the outlet duct 2 is produced. The pressing open of the valve is also assisted by a first force component F1 which emanates from the hydraulic valve clearance compensation element 6 as a consequence of the oil pressure, and by a second force component F2 which emanates from the hydraulic valve clearance compensation element 6 as a consequence of the restoring spring.

Pressing open of the outlet valve 1 by way of the two effects which are described leads to a relief of the hydraulic valve clearance compensation element 6 and, on account of the constant prevailing oil pressure and the spring force of the restoring spring of the hydraulic valve clearance compensation element, as a result to adjusting of the hydraulic valve clearance compensation element 6. The piston of the hydraulic valve clearance compensation element therefore extends. Renewed closure of the valve is prevented as a result.

A small gap of the size V1 remains between the outlet valve 1 and the valve seat ring (called the gap for short in the following text), as a result of which part of the compressed air can already flow out of the cylinder during the compression cycle in the engine. The pressure on the piston which subsequently moves downwards again (power stroke) is reduced substantially. The engine braking performance is improved as a result. Both of the upward and the downward movement of the engine piston can be used for braking purposes as a result of the throttling of the exhaust gas.

The engine speed, above which a gap between the outlet valve 1 and the valve seat ring occurs, and the size of the gap which is set between the outlet valve 1 and its valve seat ring in the engine braking mode are dependent on the following influencing variables:

(a) the exhaust gas pressure which produces the gas force F5 which acts on the outlet valve 1,
(b) the gas pressure from the combustion chamber side, which gas pressure is generated by the gas force F6 which acts in the closing direction C,
(c) the oil pressure which prevails at the hydraulic valve clearance compensation means which generates the oil pressure force F1,
(d) the spring force F2 of the restoring spring of the hydraulic valve clearance compensation means,
(e) the valve spring force F3 of the closing springs 5,
(f) the friction in the valve train, which friction produces a frictional force F4.

Figure 2:
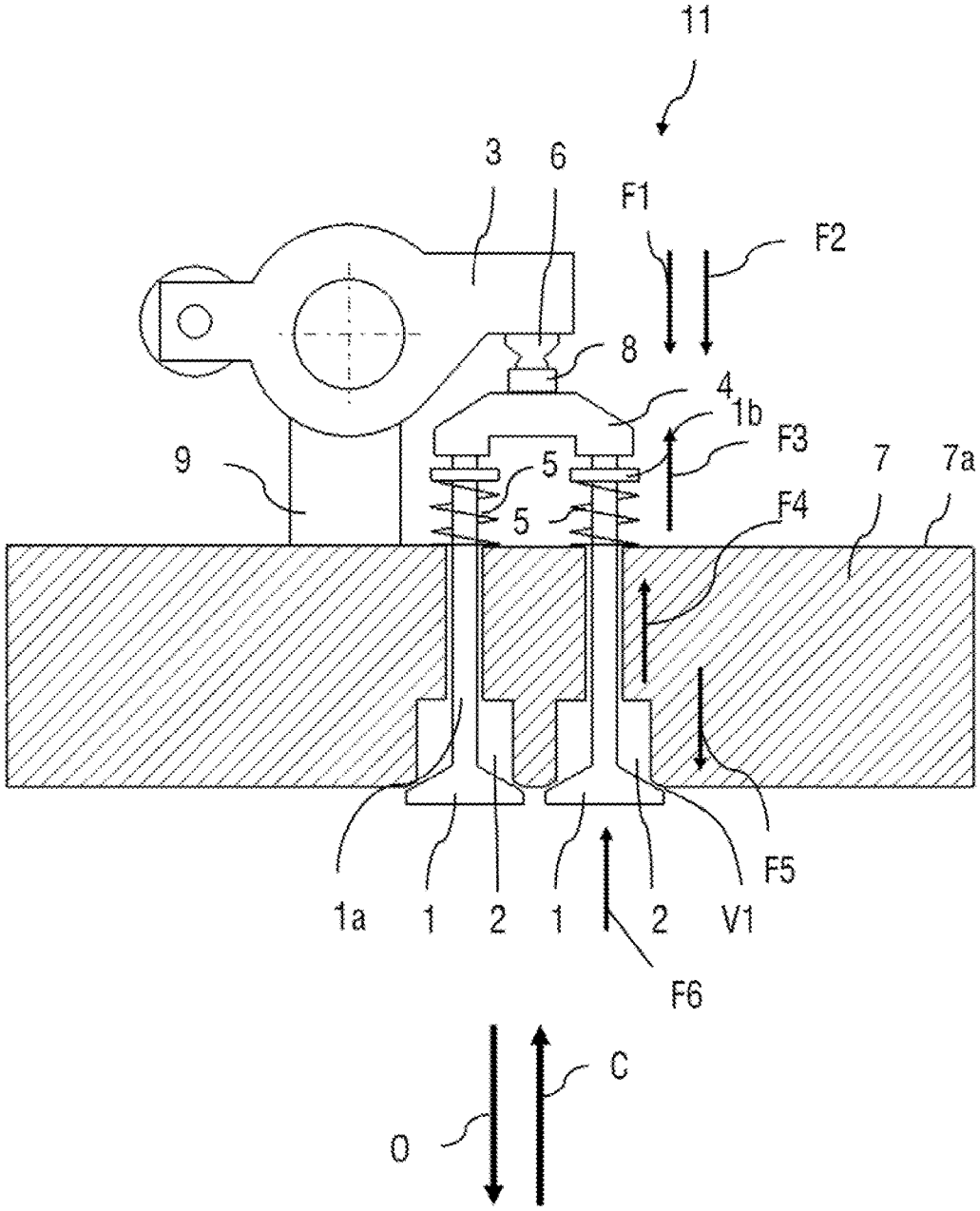
FIG. 2 shows an illustration of the forces which act during the engine braking mode on the outlet valves of the valve train of FIG. 1.

The forces F1 to F6 which act on the outlet valve 1 are shown in FIG. 2. The force F5 which is generated by the engine backpressure brake and the forces F1 and F2 which are generated by the valve clearance compensation element all act in the same direction O (opening direction), that is to say in a direction which acts towards the open position of the outlet valve 1. The spring force F3 of the closing spring 5 (restoring spring) of the outlet valve and the gas force F6 which is generated by the combustion chamber pressure in the cylinder act in the closing direction C of the outlet valve in contrast.

The maximum gap size and the engine speed, above which in each case one gap occurs between the outlet valves 1 and the associated valve seat rings can be influenced by way of adaptation of the said influencing variables and/or forces. The two outlet valves 1 therefore both jump and are held open by the hydraulic valve clearance compensation element 6 which is connected to the two outlet valves 1 via the valve crosshead 4.

A design according to the present disclosure of the internal combustion engine for adapting the engine speed limit, from which a gap occurs between the outlet valve 1 and the valve seat ring, is understood to mean an expedient adaptation of this type of the said influencing variables and/or forces. Depending on the design, the engine speed limit, from which valve jump occurs, can therefore be shifted towards greater or smaller values.

An increase in the gap between the outlet valve 1 and the valve seat ring and/or a shift of the engine speed limit towards lower engine speeds can be achieved by way of at least one of the following measures: increasing the exhaust gas pressure; reducing the gas pressure from the combustion chamber side; increasing the oil pressure which prevails at the hydraulic valve clearance compensation means; increasing the spring force of the restoring spring of the hydraulic valve clearance compensation means; reducing the valve spring force; or reducing the friction in the valve train.

If, however, it is determined on a test bench during the development of the internal combustion engine that the gap already occurs below the cut-off engine speed in the cam base circle phase in the engine braking mode, that is to say the engine speed limit is too low, one of the following measures can be performed at least in an analogous manner within the context of the design:

reducing the exhaust gas pressure, for example by way of a reduction of the closed position of the pressure flap; increasing the gas pressure from the combustion chamber side; reducing the oil pressure which prevails at the hydraulic valve clearance compensation means; reducing the spring force of the restoring spring of the hydraulic valve clearance compensation means; increasing the valve spring force; or increasing the friction in the valve train. A shift of the occurrence of the gap towards higher engine speeds and/or a reduction in the gap can be achieved by way of at least one of the said measures, with the result that the engine speed limit can be set to a suitable value above the cut-off engine speed.

In this way, the engine speed limit, above which valve jump of the outlet valve takes place in the cam base circle phase in the engine braking mode, can be set to a value which lies above the cut-off engine speed by a desired distance value.

In this way, furthermore, the gap size which is set via the valve clearance compensation element 6 and therefore the desired increase in the engine braking performance can be set. The gap always approaches a maximum value at a defined engine speed. The maximum value of the gap is set at an equilibrium of forces of the influencing variables listed above. The said maximum value increases as the engine speed rises.

Figure 3:
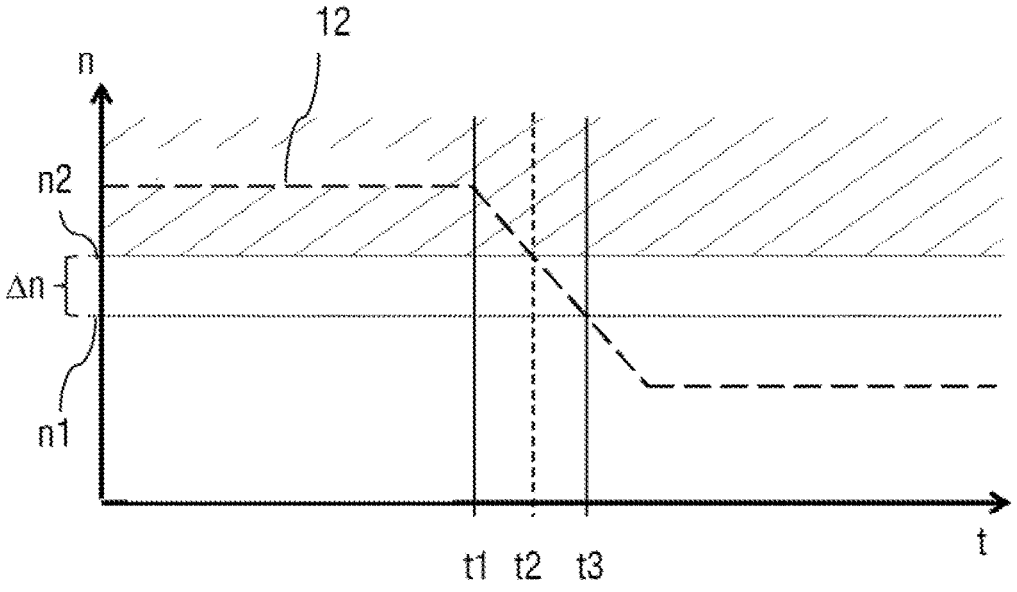
FIG. 3 shows an illustration of the transition from the engine braking mode to the combustion mode according to one embodiment of the present disclosure.

The method of operation of the engine braking device will be explained using FIG. 3 and, in particular, a transition from an engine braking mode to the subsequent combustion mode will be explained.

The curve 12 denotes an exemplary engine speed profile plotted against time. Before the time t1, the vehicle is in an engine braking mode, in which the pressure flap of the engine backpressure brake is closed. A gas force F5 of the exhaust gas pressure which acts on the outlet valve 1 is built up in the said state. A first engine braking action is therefore set. The increase in the engine braking action by way of the compression release engine brake and/or the valve jump occurs, however, only above the engine speed limit n2. As has been described above, the components of the internal combustion engine are designed in such a way that the valve jump takes place only above the engine speed limit n2. The engine speed limit is set in such a way that it lies above the cut-off engine speed n1 by the distance value Δn. The valve jump and/or the action of the compression release engine brake therefore can occur only when the combustion mode has already been deactivated.

In the engine braking mode before the time t1, a gap is therefore set between the outlet valve 1 and the valve seat ring. The gap is held open by way of the hydraulic valve clearance compensation element 6. The pressure on the piston which subsequently moves downwards again (power stroke) is reduced substantially. The engine braking performance is improved as a result.

Both the upward and the downward movement of the engine piston can be utilized for braking purposes as a result of the throttling of the exhaust gas.

In this state, the forces of oil pressure force F1, restoring spring force F2 of the hydraulic valve clearance compensation means, gas force F5 of the exhaust gas pressure, valve spring force F3, frictional force F4 and the gas force F6 which is produced by the cylinder chamber pressure are in equilibrium.

The transition from the engine braking mode into the combustion engine mode is a particular challenge. It should be ensured that the outlet valves 1 are closed completely again before the combustion engine mode, in order to prevent increased valve/seat ring wear and/or over-loading of the valve train as a result of the outlet valves 1 being open in the combustion mode.

In the present case, this is achieved by way of an expediently selected size of the distance value Δn=n2−n1, which corresponds to the distance of the engine speed limit from the cut-off engine speed.

Directly after the engine braking mode is ended at time t1, at which the exhaust gas flap of the engine backpressure brake is opened, the outlet valve 1 is first of all still open on account of the deflected piston of the hydraulic valve clearance compensation element 6.

As a result of the opening of the exhaust gas flap at time t1, however, the gas force F5 of the exhaust gas pressure is greatly reduced suddenly, and therefore the described equilibrium of forces is disrupted. The gas force F6 from the cylinder space and critically the valve spring force F3 then lead to the piston of the hydraulic valve clearance compensation element 6 returning again in the direction of the starting position and the outlet valves 1 being able to close completely again. On account of the design of the compression release engine brake and the forces which act on the outlet valve, the outlet valve is closed again at the latest when the engine speed 12 of the internal combustion engine has dropped again to the engine speed limit n2 (time t2). The combustion mode is still deactivated at this time. The combustion mode is started only at time t3, at which the engine speed reaches the cut-off engine speed n1 again.

The distance value Δn=n2−n1 can therefore expediently be selected in such a way that there is sufficient time for the outlet valve 1 to move into the closed position again after the end of the engine braking mode. The greater the distance value Δn is selected to be, the greater is the safety time period between reaching of the closed position and starting of the combustion mode. The greater the distance value Δn is selected to be, the longer is the time period of an engine speed decrease from the engine speed limit n2 to the cut-off engine speed n1 in the non-combustion mode after the end of the engine braking mode. The said time period should be greater than a closing time of the outlet valve after the end of the engine braking mode. A suitable distance value Δn can be determined, for example, experimentally by way of test bench tests.

Figure 4:
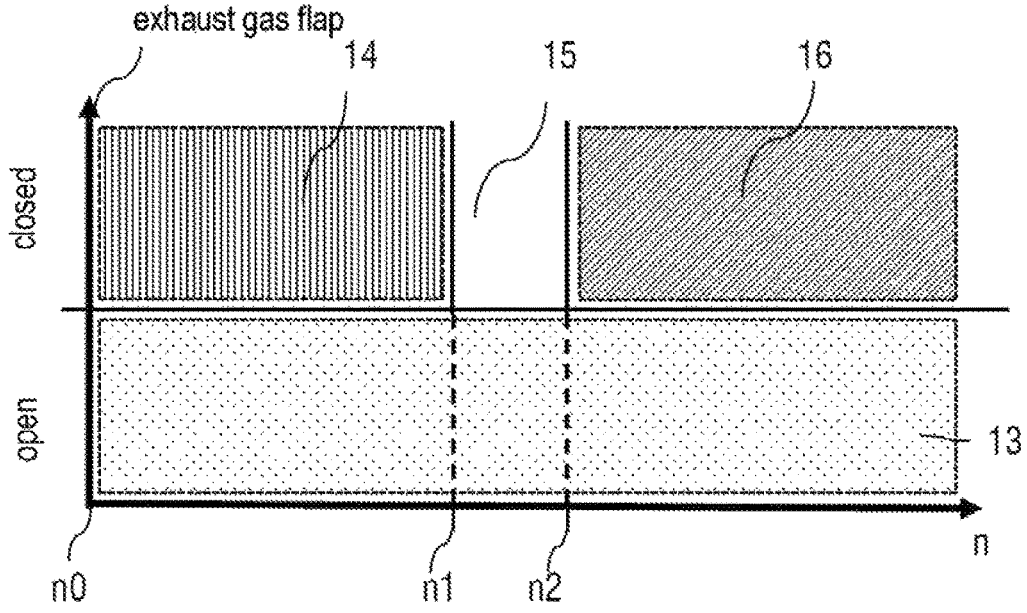
FIG. 4 shows an illustration of the ranges, in which valve jump can occur.

FIG. 4 illustrates the ranges, in which valve jump can occur. The possible positions of the exhaust gas flap which in the present case can be set only into an open position and a closed position are plotted on the ordinate axis. The exhaust gas flap is in the closed position in the engine braking mode, and otherwise in the open position.

The abscissa axis is an engine speed axis. n0 denotes the lower idling engine speed, n1 in turn denotes the cut-off engine speed (also called the upper idling engine speed), and n2 denotes the engine speed limit. A combustion engine mode is therefore possible only in the engine speed ranges between n0 and n1 on account of the engine speed limiting device 10. Only a non-combustion engine mode is possible in engine speed ranges greater than n1.

No valve jump can occur in the range 13 which denotes operating states of the vehicle, in which the engine backpressure flap is open, regardless of the engine speed, since the exhaust gas backpressure and therefore the force component F5 are too low to produce valve jump.

Valve jump is likewise not possible in the range 14 which denotes operating states of the vehicle, in which the engine backpressure flap is closed but the engine speed lies below the cut-off engine speed n1, since the exhaust gas backpressure which can be produced and therefore the force component F5 are too low in the said region to produce valve jump.

Valve jump therefore occurs in the range 16 which denotes operating states of the vehicle, in which the engine backpressure flap is closed and the engine speed lies above the engine speed limit n2, since the exhaust gas backpressure which can be produced and therefore the force component F5 are sufficiently high in the said range to produce a valve jump. No combustion mode can take place in the said region, however, since the engine speed lies above the cut-off engine speed n1.

The range 15 which denotes operating states of the vehicle, in which the engine backpressure flap is closed and the engine speed lies between the cut-off engine speed n1 and the engine speed limit n2, represents a transition region which ensures that an outlet valve 1 which is open in the cam base circle phase in the engine braking mode can close again before the combustion mode starts again. The transition region 15 therefore ensures that no valve is open in the cam base circle phase in the combustion mode.

Although the present disclosure has been described with reference to defined exemplary embodiments, a person skilled in the art can see that various amendments can be performed and equivalents can be used as a replacement, without departing from the scope of the present disclosure. In addition, a large number of modifications can be carried out without departing from the associated scope. As a result, the present disclosure is not to be limited to the disclosed exemplary embodiments, but rather is to comprise all exemplary embodiments which fall within the scope of the appended patent claims. In particular, the present disclosure also claims protection for the subject matter and the features of the subclaims regardless of the claims which are referred to.

LIST OF REFERENCE NUMERALS

1 Outlet valve
1*a* Stem
1*b* Spring collar
2 Outlet duct
3 Rocker arm
4 Valve crosshead
5 Closing spring
6 Valve clearance compensation element
7 Cylinder head
7*a* Cylinder head surface
8 Supporting cap
9 Bearing block
10 Engine speed limiting device
11 Valve train
12 Engine speed characteristic
13, 14 Range without valve jump
15 Transition region
16 Range with valve jump
t1 End of engine braking mode
t2 Reaching of engine speed limit
t3 Start of combustion mode
F1 Oil pressure force of the hydraulic valve clearance compensation element
F2 Spring force of the hydraulic valve clearance compensation element
F3 Spring force of the closing spring
F4 Frictional force
F5 Gas force by way of the engine backpressure brake
F6 Gas force by way of the combustion chamber pressure in the cylinder
V1 Gap size between the outlet valve and the valve seat ring

We claim:

1. An internal combustion engine comprising:

at least one outlet valve in communication with a cylinder, the outlet valve actuated via a camshaft and a transmission device;

a hydraulic valve clearance compensation element arranged in the transmission device between the camshaft and the outlet valve;

an engine braking device, including an engine backpressure brake for building up an exhaust gas backpressure and a compression release engine brake, by way of which at least one outlet valve can be held open at least in an engine braking phase, wherein the compression release engine brake is formed by the hydraulic valve clearance compensation element;

an engine speed limiting device configured to deactivate an injection of fuel above a predetermined cut-off engine speed (n1), wherein the transmission device, the engine backpressure brake and the hydraulic valve clearance compensation element are designed in such a way that an engine speed limit (n2), above which a gap occurs between the outlet valve and an associated valve seat ring in a cam base circle phase in the engine braking mode, lies above the cut-off engine speed (n1) by a distance value (Δn).

2. The internal combustion engine according to claim 1, wherein the transmission device, the engine backpressure brake and the hydraulic valve clearance compensation element are designed in such a way that a sum of the forces which act in the closing direction on the outlet valve in a cam base circle phase is greater only in the case of an engine speed of the internal combustion engine below the predetermined engine speed limit (n2) than the sum of the forces which act in an opening direction, with the result that the outlet valve is held in the closed position in the cam base circle phase at an engine speed of the internal combustion engine below the engine speed limit (n2) and is moved into the open position at an engine speed of the internal combustion engine which is greater than or equal to the engine speed limit (n2).

3. The internal combustion engine according to claim 2, wherein (a) the forces which act in the closing direction include: a valve spring force of the outlet valve and a gas pressure force which is produced on the combustion chamber side; and (b) the forces which act in an opening direction include: a gas pressure force of the exhaust gas pressure which is produced by the engine backpressure brake, an oil pressure force which is produced by the valve clearance compensation element, and a spring force of the restoring spring of the hydraulic valve clearance compensation element.

4. The internal combustion engine according to one of claim 1, wherein the hydraulic valve clearance compensation element includes a piston which adjoins a pressure space and an oil pressure line which opens into the pressure space via a check valve which is loaded by way of a spring.

5. The internal combustion engine according to claim 4, wherein the piston, the check valve and the spring of the hydraulic valve clearance compensation element are arranged between the valve lever and the valve crosshead.

6. The internal combustion engine according to claim 1, wherein the transmission device includes:

(a) a valve crosshead (4); and (b) a valve lever which is configured as a rocker arm (3) or drag lever, is driven by the camshaft and acts on the outlet valves (1) via the valve crosshead (4).

7. A motor vehicle, in particular a commercial vehicle, comprising:

at least one outlet valve in communication with a cylinder, the outlet valve actuated via a camshaft and a transmission device;

a hydraulic valve clearance compensation element arranged in the transmission device between the camshaft and the outlet valve;

an engine braking device, including an engine backpressure brake for building up an exhaust gas backpressure and a compression release engine brake, by way of which at least one outlet valve can be held open at least in an engine braking phase, wherein the compression release engine brake is formed by the hydraulic valve clearance compensation element an engine speed limiting device configured to deactivate an injection of fuel above a predetermined cut-off engine speed (n1), wherein the transmission device, the engine backpressure brake and the hydraulic valve clearance compensation element are designed in such a way that an engine speed limit (n2), above which a gap occurs between the outlet valve and an associated valve seat ring in a cam base circle phase in the engine braking mode, lies above the cut-off engine speed (n1) by a distance value (Δn).

* * * * *